US006069520A

United States Patent [19]

Yamamoto et al.

[11] Patent Number: 6,069,520

[45] Date of Patent: May 30, 2000

[54] CONSTANT CURRENT CIRCUIT USING A CURRENT MIRROR CIRCUIT AND ITS APPLICATION

[75] Inventors: Tomohisa Yamamoto; Hiroyuki Ban, both of Aichi-ken, Japan

[73] Assignee: Denso Corporation, Kariya, Japan

[21] Appl. No.: 09/112,058

[22] Filed: Jul. 9, 1998

[30] Foreign Application Priority Data

Jul. 9, 1997 [JP] Japan ..... 9-184160

[51] Int. Cl.[7] ..... G05F 1/10

[52] U.S. Cl. ..... 327/538; 361/100

[58] Field of Search ..... 327/530, 538, 327/540; 323/312, 313, 315; 361/93, 100

[56] References Cited

U.S. PATENT DOCUMENTS

| | | | |
|---|---|---|---|
| 4,442,398 | 4/1984 | Bertails et al. | 323/315 |
| 4,578,633 | 3/1986 | Aoki | 323/315 |
| 4,583,037 | 4/1986 | Sooch | 323/315 |
| 4,897,614 | 1/1990 | Nishio | 330/257 |
| 4,958,086 | 9/1990 | Wang et al. | 323/312 |
| 5,012,133 | 4/1991 | Hughes | 323/312 |
| 5,349,285 | 9/1994 | Okanobu | 323/312 |
| 5,805,010 | 9/1998 | Wu | 327/530 |

FOREIGN PATENT DOCUMENTS

| | | |
|---|---|---|
| 5-83872 | 11/1993 | Japan . |
| 2542623 | 7/1996 | Japan . |

*Primary Examiner*—Jung Ho Kim

*Attorney, Agent, or Firm*—Pillsbury Madison & Sutro LLP

[57] ABSTRACT

A current mirror circuit includes an input transistor and an output transistor. A first bipolar transistor has a collector terminal connected to a predetermined reference portion of a current supply path of a power source and an emitter terminal connected to a collector terminal of the output transistor for absorbing an electrical potential difference between the reference portion and the collector terminal of the output transistor. A second bipolar transistor has a base terminal connected to the emitter terminal of the first bipolar transistor and a collector terminal connected to a base terminal of the first bipolar transistor for fixing an electrical potential of the collector terminal of the output transistor to a base-emitter voltage of the second bipolar transistor.

2 Claims, 7 Drawing Sheets

CONSTANT CURRENT CIRCUIT USING A CURRENT MIRROR CIRCUIT AND ITS APPLICATION

BACKGROUND OF THE INVENTION

The present invention relates to a constant current circuit using a current mirror circuit, preferably employed in a throttle control comparator for an electronic control unit of an internal combustion engine or an anti-skid control apparatus of an automotive vehicle.

Unexamined Japanese Patent Publication No. 1-21616, corresponding to the U.S. Pat. No. 4,897,614, discloses a conventional constant current circuit using a current-mirror circuit. FIG. 8 shows a fundamental circuit arrangement of this conventional constant current circuit.

This conventional constant current circuit comprises a constant current source 101 supplying a constant current I1. Two NPN transistors 102 and 103 cooperatively constitute a current mirror circuit 104 receiving the current I1 supplied from the constant current source 101. The current I2 flowing from the power source 105 is made constant by the current mirror circuit 104. At a predetermined portion in the circuit, a reference voltage Vref is detectable as a value smaller than a power source voltage VB by a constant amount equivalent to a voltage drop at a resistor 106.

According to this conventional constant current circuit, the current I2 flows across the transistor 103 when the constant current source 101 supplies the constant current I1 to the transistor 102. However, the current I2 is responsive to a variation of the power source voltage VB.

FIG. 9 shows a relationship between the power source voltage VB and the currents I1 and I2. As apparent from the characteristics shown in FIG. 9, the current I2 increases in accordance with an increase of the power source voltage VB due to a so-called early effect of the transistor 103. The early effect is a phenomenon that a depletion layer of a transistor is widened depending on a bias voltage between collector and base terminals. When the collector-emitter voltage increases, the collector current increases even when the base current is constant. For example, when the power source voltage VB changes from 6V to 20V, the current I2 increases from 650 $\mu$A to 850 $\mu$A.

The voltage drop at the resistor 106 varies in proportion to the variation of the current I2. This gives an adverse influence to the detectable reference voltage Vref.

SUMMARY OF THE INVENTION

In view of the problems in the prior art, an object of the present invention is to provide a constant current circuit capable of maintaining the current flowing from the power source at a constant value irrespective of any variation of the power source voltage, thereby assuring an accurate detection of the reference voltage.

In order to accomplish this and other related objects, an aspect of the present invention provides a constant current circuit comprising a current mirror circuit including an input transistor and an output transistor. A current supply path extends from a power source to the output transistor via a predetermined reference portion. A buffer means is provided in the current supply path for absorbing an electrical potential difference between the reference portion and an output terminal of the output transistor. A clamp means is provided for fixing an electrical potential of the output terminal of the output transistor.

Preferably, the buffer means is a first bipolar transistor having collector and emitter terminals for absorbing the electrical potential difference between the reference portion and the output terminal of the output transistor.

Preferably, the clamp means is a second bipolar transistor having base and emitter terminals for fixing the electrical potential of the output terminal of the output transistor to a base-emitter voltage of the second bipolar transistor.

Preferably, a base current supplied to the first bipolar transistor compensates a base current flowing into the second bipolar transistor from the output terminal of the output transistor.

Preferably, the constant current circuit further comprises a constant current generating means for generating a constant current to activate the first bipolar transistor, wherein the constant current supplied from the constant current generating means is substantially identical with a collector current of the first bipolar transistor.

Preferably, the constant current generating means comprises a constant voltage source and a resistor.

Another aspect of the present invention provides a constant current circuit comprising a current mirror circuit including an input transistor and an output transistor having base terminals connected each other. A first bipolar transistor has a collector terminal connected to a predetermined reference portion of a current supply path of a power source and an emitter terminal connected to a collector terminal of the output transistor for absorbing an electrical potential difference between the reference portion and the collector terminal of the output transistor. A second bipolar transistor has a base terminal connected to the emitter terminal of the first bipolar transistor and a collector terminal connected to a base terminal of the first bipolar transistor for fixing an electrical potential of the collector terminal of the output transistor to a base-emitter voltage of the second bipolar transistor.

Preferably, a resistor interposes between the reference portion and the power source in the current supply path for detecting a reference voltage at the reference portion as a value smaller than a power source voltage by an amount equivalent to a voltage drop caused at the resister when a constant current flows along the current supply path.

Furthermore, another aspect of the present invention provides a load actuating circuit comprising a switching means having a first terminal receiving a power source voltage, a second terminal connected to a ground via a load, and a control terminal connected to a control circuit. A resistor has one end connected to the first terminal of the switching means and the other end connected to a constant current circuit for causing a constant voltage drop. A comparator has one input terminal connected to the other end of the resistor and the other input terminal connected to the second terminal of the switching means for detecting an excessive current flowing across the load by comparing the constant voltage drop at the resistor with a momentary voltage drop between the first and second terminals of the switching means.

The constant current circuit provided in this load actuating circuit comprises a current mirror circuit including an input transistor and an output transistor. A buffer means is provided for absorbing an electrical potential difference between the other end of the resistor and an output terminal of the output transistor. A clamp means is provided for fixing an electrical potential of the output terminal of the output transistor.

Preferably, the comparator comprises a pair of differential transistors and an auxiliary constant current circuit for activating the paired differential transistors. The auxiliary constant current circuit includes an input transistor and an output transistor cooperatively constituting a current mirror circuit and a buffer means and clamp means functioning in the same manner as those in the above-described constant current circuit.

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF THE PREFERRED EMBODIMENTS

Figure 1:
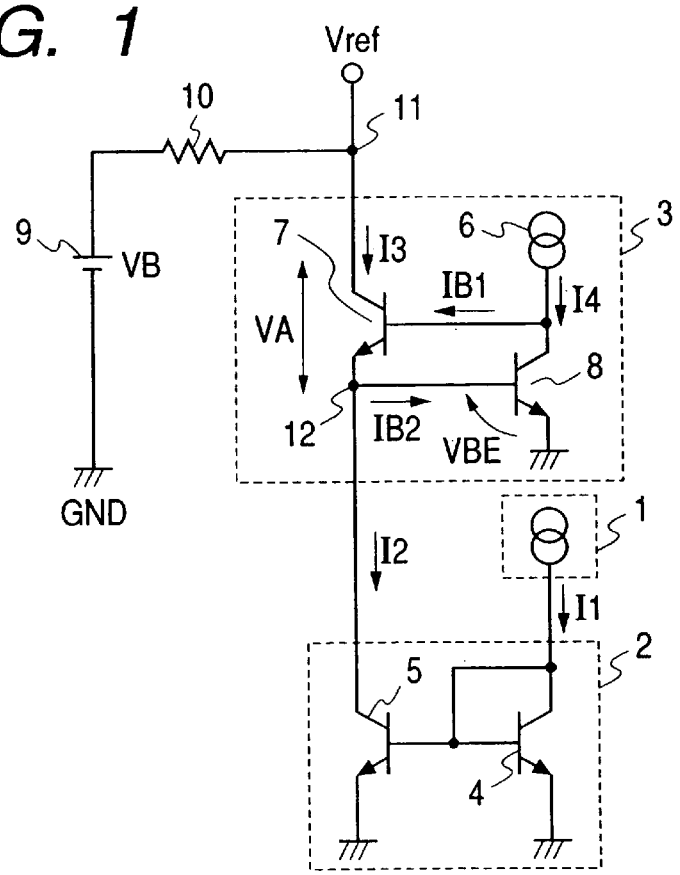
FIG. 1 is a circuit diagram showing a first embodiment of the constant current circuit in accordance with the present invention.

Preferred embodiments of the present invention will be explained hereinafter with reference to attached drawings. Identical parts are denoted by the same reference numerals throughout the views.

First Embodiment

FIG. 1 shows a first embodiment of the constant current circuit in accordance with the present invention.

The constant current circuit of this embodiment comprises a constant current source 1, a current mirror circuit 2 and an early effect cancel circuit 3.

The current mirror circuit 2 comprises two NPN transistors respectively serving as input and output transistors 4 and 5 that have base terminals directly connected each other. The constant current source 1 supplies a constant current I1 to the connector terminal of the input transistor 4. In response to the supplied constant current I1, a collector current I2 flows across the output transistor 5 in the current mirror circuit 2.

The early effect cancel circuit 3 comprises a constant current source 6 and two NPN transistors (i.e., bipolar transistors) 7 and 8. A power source 9 is connected to the early effect cancel circuit 3 via a resistor 10. The early effect cancel circuit 3 has a function of canceling the early effect to maintain the collector current I2 at a constant value irrespective of a variation of a power source voltage VB. By the function of the early effect cancel circuit 3, the current flowing into the early effect cancel circuit 3 (i.e., collector current I3 of the transistor 7) from the power source 9 remains constant. Thus, a voltage drop at the resistor 10 is constant. A reference voltage Vref is detectable at a predetermined reference portion 11 between the resistor 10 and the transistor 7. The reference voltage Vref is smaller than the terminal voltage VB by a constant amount equivalent to the voltage drop at the resistor 10.

For example, the detectable reference voltage Vref is 5V smaller than the power source voltage VB when the constant current I3 causes the voltage drop of 5V at the resistor 10.

The above-described constant current circuit operates in the following manner.

In the early effect cancel circuit 3, the collector current I3 flows across the transistor 7 in response to a base current IB1 supplied from the constant current source 6. When the transistor 7 turns on, a base current IB2 flows into a base terminal of the transistor 8 to activate the transistor 8. A base-emitter voltage $V_{BE}$, i.e., a voltage applied between the base terminal and the emitter terminal of the transistor 8, is constant. The emitter terminal of the transistor 8 is grounded. Thus, the base-emitter voltage $V_{BE}$ is equivalent to an electrical potential of a connecting point 12 between the emitter of the transistor 7 and the collector of the output transistor 5. In other words, the electrical potential of the connecting point 12 is fixed to $V_{BE}$. In this manner, the transistor 8 has a function of clamping the electrical potential of the collector terminal of the output transistor 5 (or the emitter terminal of the transistor 7).

Furthermore, the transistor 7 acts as a buffer for absorbing an electrical potential difference in a current path extending from the power source 9 to the output transistor 5. To maintain the constant current I3 flowing across the resistor 10, it is necessary to absorb an electrical potential difference VA caused between the reference voltage (Vref) detecting terminal 11 and the collector terminal (i.e., connecting point) 12 of the output transistor 5. The transistor 7 absorbs this electrical potential difference VA.

More specifically, the collector-emitter voltage of the transistor 7 varies in accordance with a variation of the power source voltage VB. However, when the transistor 7 is in an active region, a constant current flows across the transistor 7 irrespective of a change of the collector-emitter voltage. Utilizing this nature, the transistor 7 can absorb the electrical potential difference while maintaining the constant current.

Figure 2:
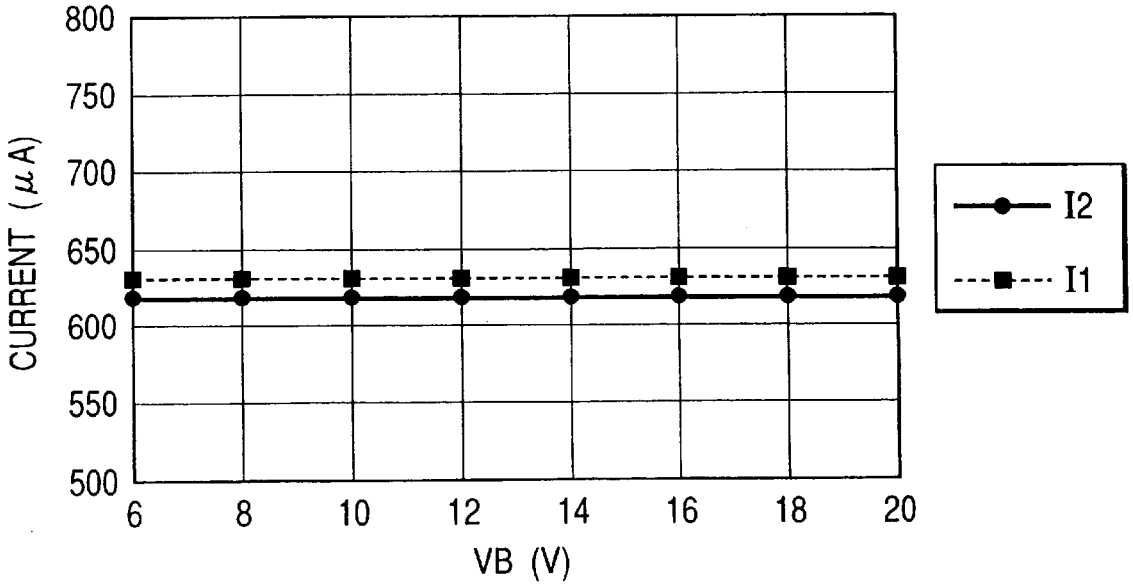
FIG. 2 is a graph showing a relationship between a power source voltage and transistor currents in the constant current circuit shown in FIG. 1.

In this manner, the first embodiment fixes the collector potential of the output transistor 5 to the constant value by the transistor 8 and absorbs the electrical potential difference VA between the terminals 11 and 12 by the transistor 7. Accordingly, the current flowing across the resistor 10 remains constant. FIG. 2 shows a relationship between the power source voltage VB and the currents I1 and I2. As apparent from FIG. 2, the collector current I2 flowing across the output transistor 5 remains constant irrespective of the variation of the power source voltage VB.

Accordingly, the circuit arrangement of the first embodiment makes the voltage drop at the resistor 10 constant even when the power source voltage VB varies. The reference voltage Vref is detectable as a value accurately reflecting the variation of the power source voltage VB. Thus, the detected reference voltage Vref is indirect but accurately reflects the variation of the power source voltage VB.

If the transistor 7 is not provided under supply of the constant collector current I2 to the output transistor 5, an excessively large base current will be supplied to the transistor 8. Providing the transistor 7 as the buffer is effective to prevent the transistor 8 from being damaged.

Furthermore, when the transistor 7 is not provided, part of the current I3 supplied from the power source 9 flows as the base current IB2 into the base terminal of the transistor 8. Thus, the collector current I2 of the output transistor 5 becomes smaller than the current I3 supplied from the power source 9 by the amount IB2. However, providing the transistor 7 makes it possible to add the base current IB1 of the transistor 7 to the collector current I2 of the output transistor 5. The added base current IB1 compensates the lost base current IB2.

More specifically, considering the current flowing into and out of the transistor 7, the following relationship is established.

$$I3+IB1=I2+IB2$$

Furthermore, when "hfe" represents a current amplification factor of the transistors 7 and 8, the following is established.

$$IB1=I3/hfe$$

$$IB2=(I4-IB1)/hfe$$

From the above three equations, the following is derived.

$$I3=I2+IB2-IB1$$

$$=I2+(I4-IB1)/hfe-IB1$$

$$=I2+I4/hfe-I3/hfe(1+1/hfe)$$

$$=I2+I4/hfe-I3/hfe-I3/(hfe)^2$$

In the derived equation, the final term "$I3/(hfe)^2$" is negligible.

When I4=I3, the collector current I3 becomes substantially identical with the collector current I2. Thus, the difference between the collector current I2 and the collector current I3 is minimized.

As described in the foregoing description, the first embodiment provides the transistor 7 functioning as the buffer that has the base current IB1 capable of compensating the current loss (i.e., base current IB2) at the connecting point 12.

Second Embodiment

Figure 3:
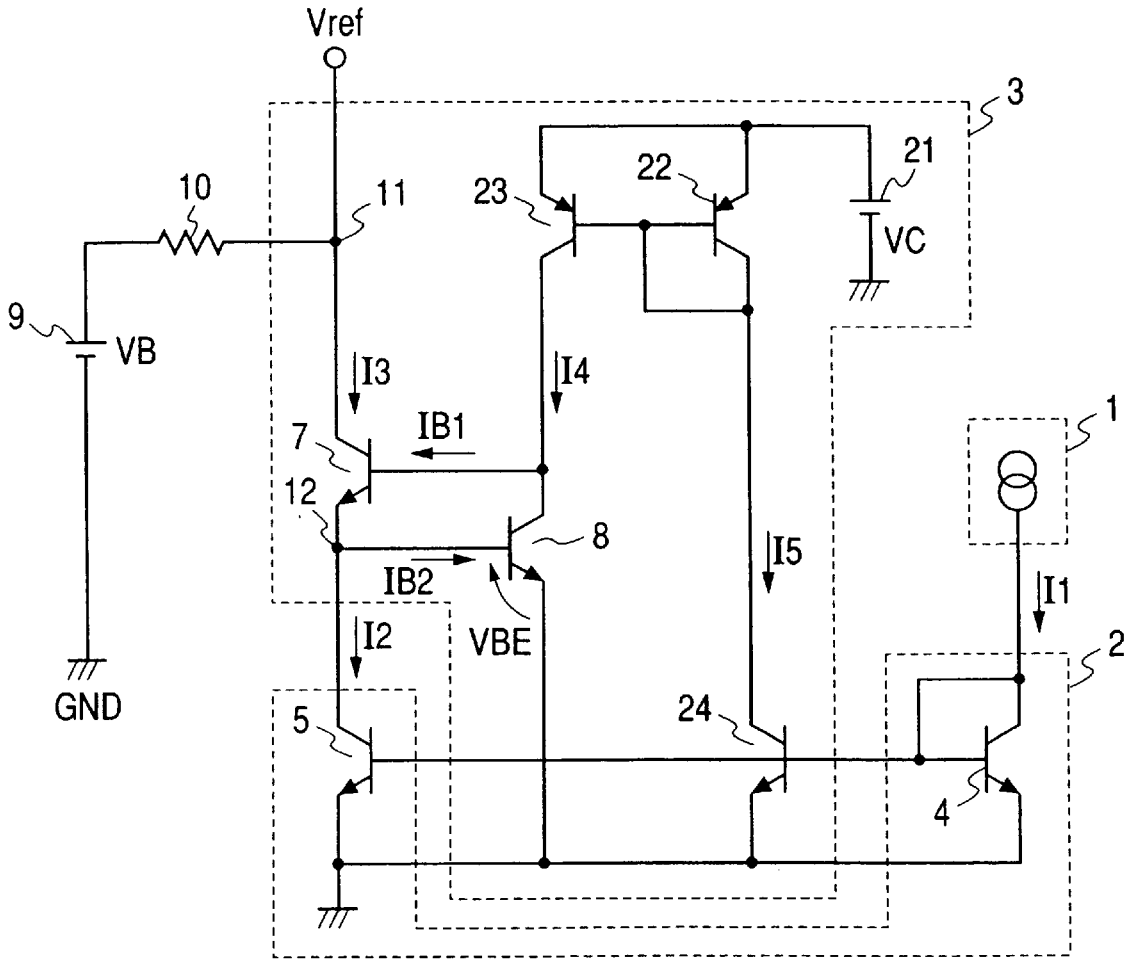
FIG. 3 is a circuit diagram showing a second embodiment of the constant current circuit in accordance with the present invention.

FIG. 3 shows a second embodiment of the constant current circuit in accordance with the present invention. The early effect cancel circuit 3 of the second embodiment comprises a power source 21 (e.g., DC 5V) serving as a constant current source. The early effect cancel circuit 3 further comprises transistors 22, 23 and 24 activated by the power source voltage VC of the power source 21.

The transistor 24 is connected to the base terminal of the transistor 4. The current I1 flowing from the constant current source 1 activates the transistor 4. A collector current I5 of the transistor 24 flows in response to the current I1. Upon the transistor 24 becoming active, currents flow across other transistors 22 and 23.

The emitter current of transistor 23 becomes I4. The transistors 7 and 8 operate in the same manner as described in the first embodiment. The transistor 8 clamps the output transistor 5. The collector potential of output transistor 5 becomes identical with the base-emitter voltage $V_{BE}$ of the transistor 8. By the clamping function of the transistor 8, the collector current I2 remains constant. Accordingly, even when the power source voltage VB varies, the voltage drop at the resistor 10 remains constant. It becomes possible to detect the reference voltage Vref accurately corresponding to the varied power source voltage VB.

Figure 4:
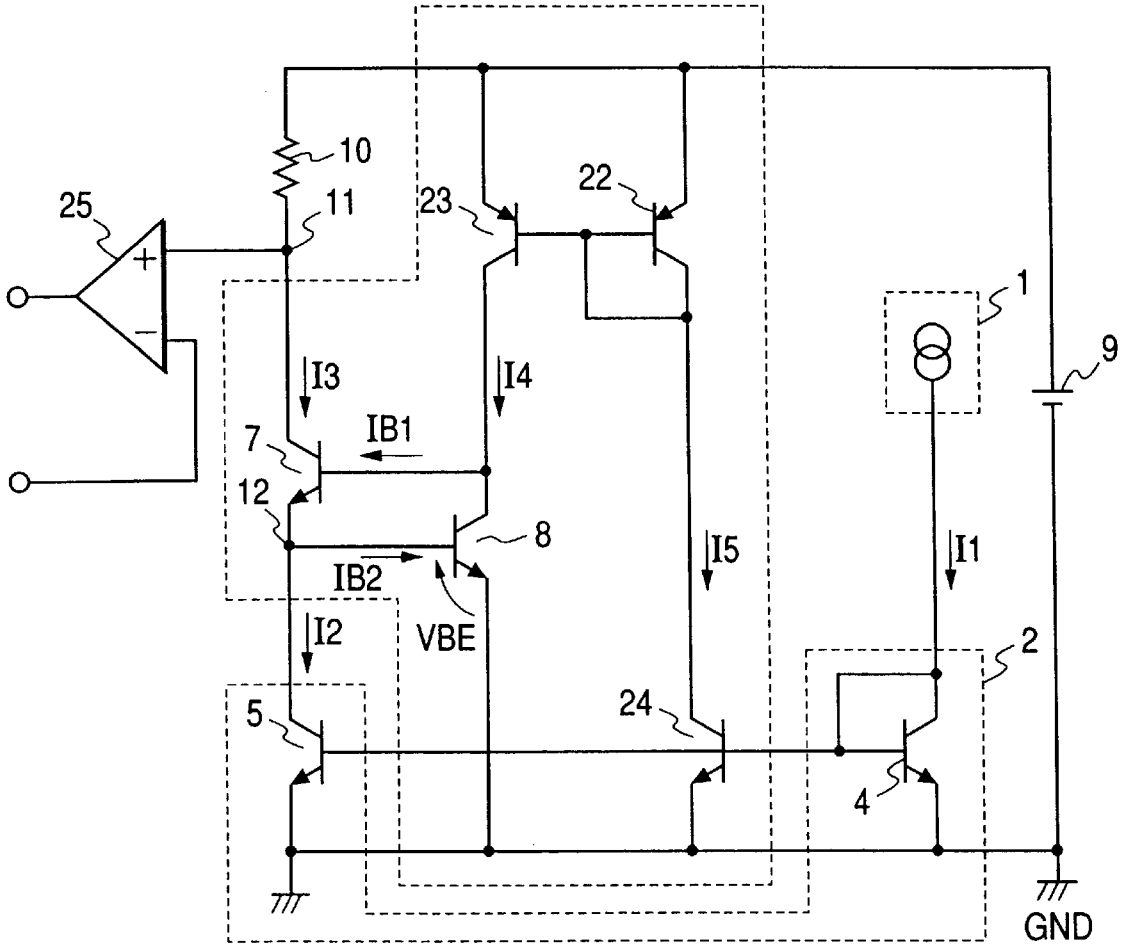
FIG. 4 is a circuit diagram showing a practical use of the constant current circuit shown in FIG. 3.

FIG. 4 shows a practical use of the constant current circuit shown in FIG. 3. According to the circuit shown in FIG. 4, a non-inversion input terminal of a comparator 25 receives the reference voltage Vref from the terminal 11 of the constant current circuit. An inversion input terminal of the comparator 25 receives an external voltage. The comparator 25 compares the entered external voltage with the reference voltage Vref.

As described above, the current I3 flowing across the resistor 10 determines the reference voltage Vref. The current I3 is not influenced by the characteristics of the power source 9. Hence, even when the power source voltage VB varies, it is possible to detect the reference voltage Vref corresponding to the varied power source voltage VB. Thus, the realized comparator operation is highly accurate.

Furthermore, the power source voltage VB of the power source 9 can be a reference value for the external voltage entered in the inversion input terminal of the comparator 25. The realized detection is highly accurate in the same manner as the reference voltage Vref.

Furthermore, according to the circuit shown in FIG. 4, the power source 9 performs the same function as the constant current source realized by the power source 21 shown in FIG. 3. Due to the early effect, the collector current I5 of the transistor 24 is influenced by the characteristics of the power source 9. The power source voltage characteristics may give an influence to the base current of the transistor 23. However, the influence to the current I4 is within a level of I4/hfe. The actual influence of the early effect is very small.

Third Embodiment

Figure 5:
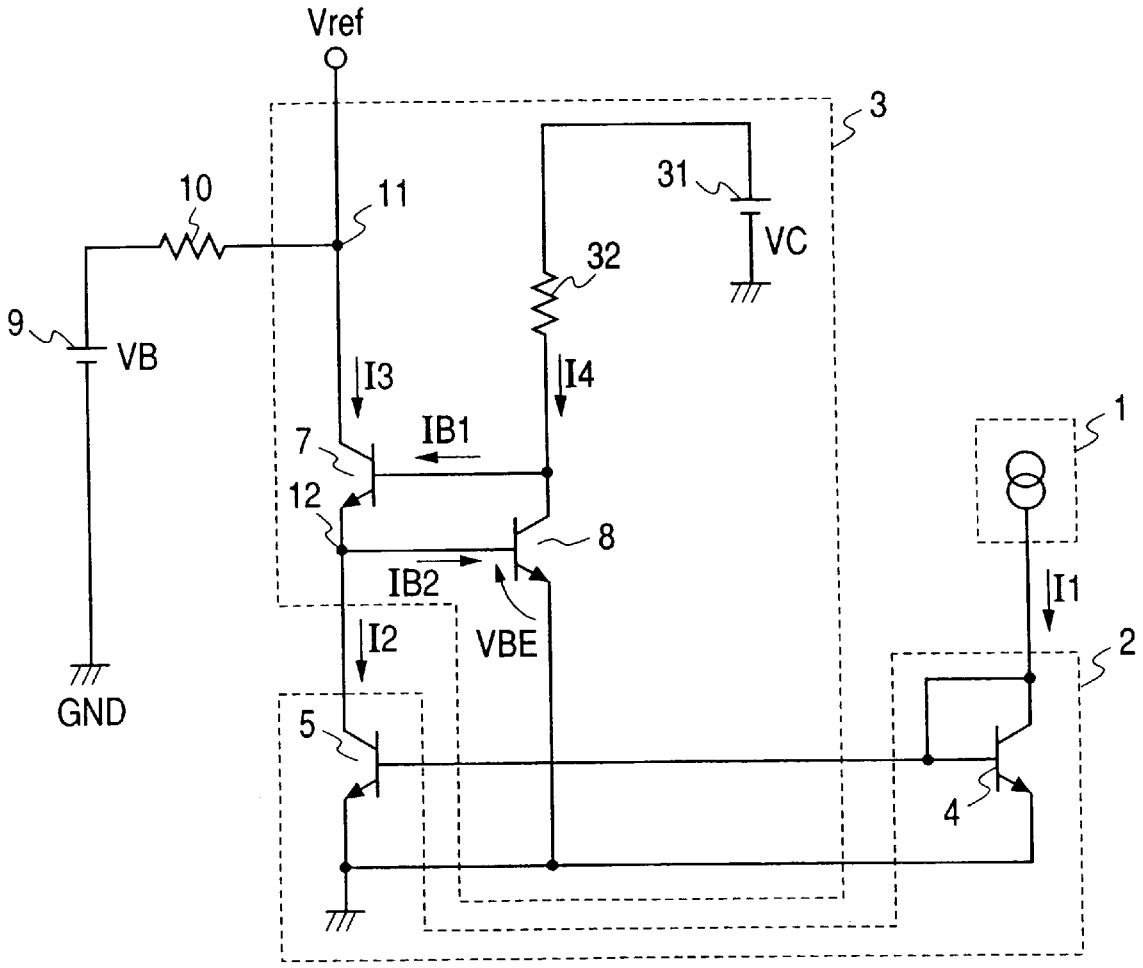
FIG. 5 is a circuit diagram showing a third embodiment of the constant current circuit in accordance with the present invention.

FIG. 5 shows a third embodiment of the constant current circuit in accordance with the present invention. The early effect cancel circuit 3 of the third embodiment comprises a power source 31 (e.g., DC 5V) serving as a constant voltage source. The early effect cancel circuit 3 further comprises a resistor 32 across which a constant current flows from the power source 31. The power source 31 and the resistor 32 cooperatively function in the same manner as the constant current source 6 shown in FIG. 1. Using the resistor 32 is advantageous in that the circuit arrangement is simplified.

Figure 6:
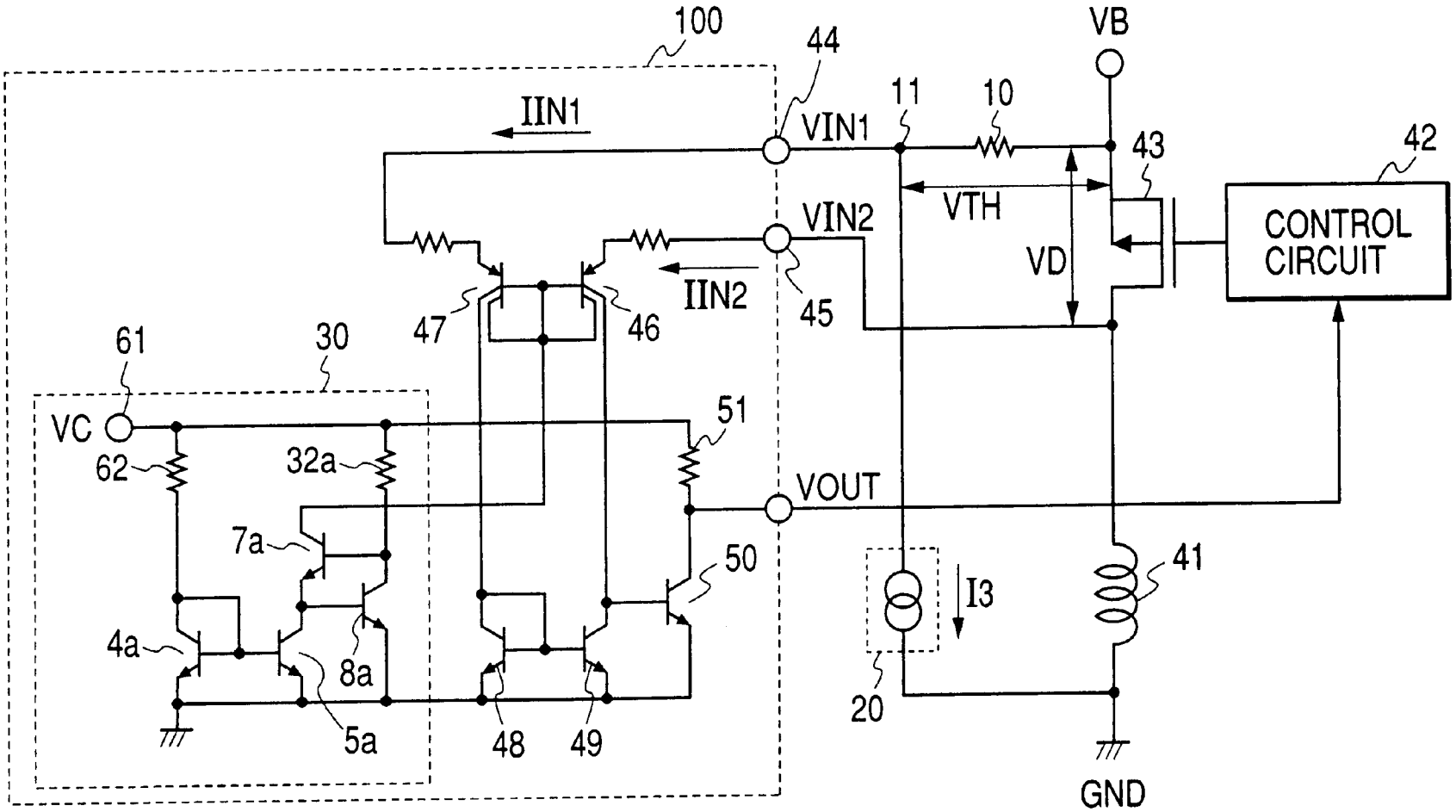
FIG. 6 is a circuit diagram showing a practical use of the constant current circuit shown in FIG. 5.

FIG. 6 shows a practical use of the constant current circuit shown in FIG. 5. The circuit shown in FIG. 6 is a load actuating circuit capable of protecting a load 41 from any excessive current. When the load 41 is short-circuited, an excessive current flows across the load 41. In response to the excessive current, a control circuit 42 turns off a power MOS transistor 43, thereby preventing the load 41 from being fatally damaged.

A drain terminal of the power MOS transistor 43 has an electrical potential VIN2. An inversion input terminal 45 of a comparator 100 receives the drain voltage VIN2 of the power MOS transistor 43. A non-inversion input terminal 44 of the comparator 100 receives a voltage VIN1 which is lower than the source potential of the power MOS transistor 43 by an amount equivalent to a voltage drop $V_{TH}$ at the resistor 10. The comparator 100 comprises a pair of differential transistors 46 and 47 for comparing the entered voltages VIN1 and VIN2. The control circuit 42 receives the comparison result from the comparator 100 to on-and-off control the power MOS transistor 43.

When no excessive current flows, the power MOS transistor 43 causes an offset voltage $V_D$ due to an ON-resistance between the source and drain terminals of the power MOS transistor 43. The electrical potential of the drain becomes lower than the electrical potential of the source terminal. However, the voltage VIN2 is higher than the voltage VIN1 because the resistor 10 causes the voltage drop $V_{TH}$ (i.e., $V_D < V_{TH}$).

Accordingly, a current IIN2 activates the transistor 46 and deactivates other transistors 47 to 49. This activates a transistor 50. The transistor 50 has an emitter terminal connected to the ground and a collector terminal connected via a resistor 51 to a terminal 61 as well as an output terminal VOUT. Thus, the comparator 100 generates a low-level signal from its output terminal VOUT connected to the collector terminal of the transistor 50. The generated low-level signal is sent to the control circuit 42.

When any excessive current flows, an extremely large current flows across the power MOS transistor 43. The offset voltage $V_D$ of the power MOS transistor 43 increases and exceeds the voltage drop $V_{TH}$ at the resistor 10 (i.e., $V_D > V_{TH}$). The voltage VIN1 becomes larger than the voltage VIN2.

Accordingly, the current IIN1 activates transistors 47 to 49 and deactivates the transistor 46. This deactivates the transistor 50. Thus, the comparator 100 generates a high-level signal from its output terminal VOUT. The generated high-level signal is sent to the control circuit 42.

If the current IIN1 flowing across the resistor 10 varies in response to a variation of the power source voltage VB, the comparison between the voltages VIN1 and VIN2 will become inaccurate. To present such a drawback, this embodiment provides the constant current circuit shown in FIG. 6. The provided circuit arrangement surely prevents the variation of the current IIN1.

As described above, the constant current circuit of the present invention can be incorporated in the comparator 100 used for detecting an excessive current in the load 41.

According to a constant current circuit 30 shown in FIG. 6, the terminal 61 is functionally equivalent to the power source 31 shown in FIG. 5 in that it applies the power source voltage VC to a resistor 32*a*. The current flowing across a transistor 8*a* becomes constant. Furthermore, the power source voltage VC of the terminal 61 activates an input transistor 4*a*. The current flowing across an input transistor 4*a* via a resistor 62 becomes constant. In other words, the terminal 61 is functionally equivalent to the constant current source 1 shown in FIG. 5.

As described above, it is possible to use the single power source voltage VC to activate both the transistors 8*a* and 4*a*. Furthermore, using the resistors 32*a* and 63 can simplify the circuit arrangement of the constant current circuit 30.

Figure 7:
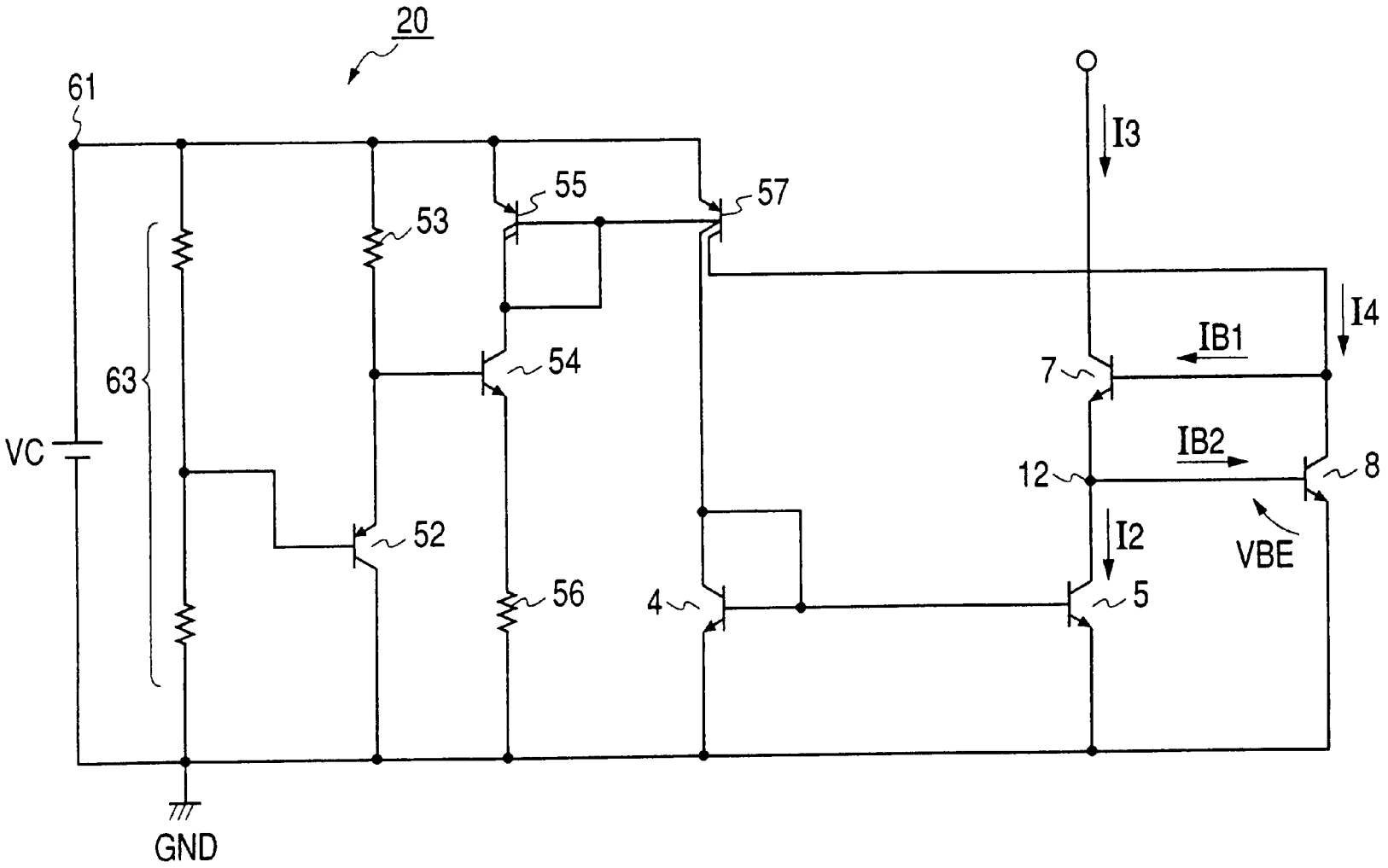
FIG. 7 is a circuit diagram showing a current source used in the constant current circuit shown in FIG. 6.
Figure 8:
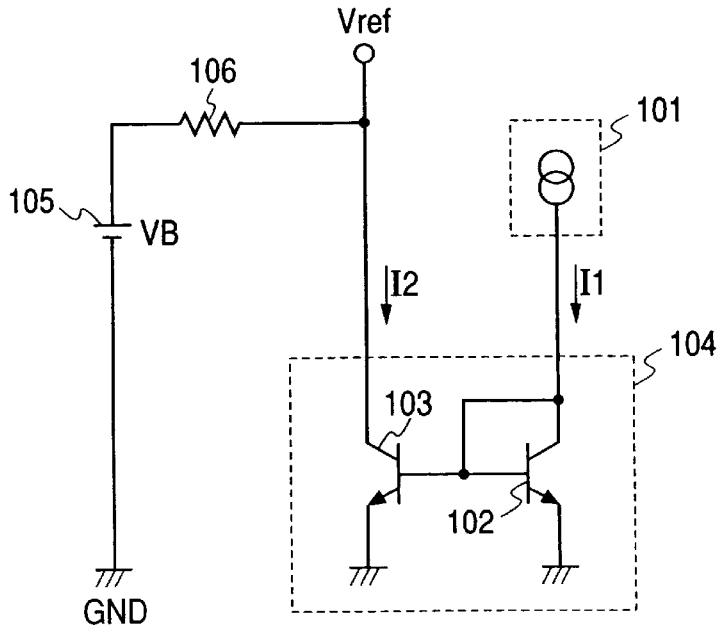
FIG. 8 PRIOR ART
FIG. 8 is a circuit diagram showing a conventional constant current circuit.
Figure 9:
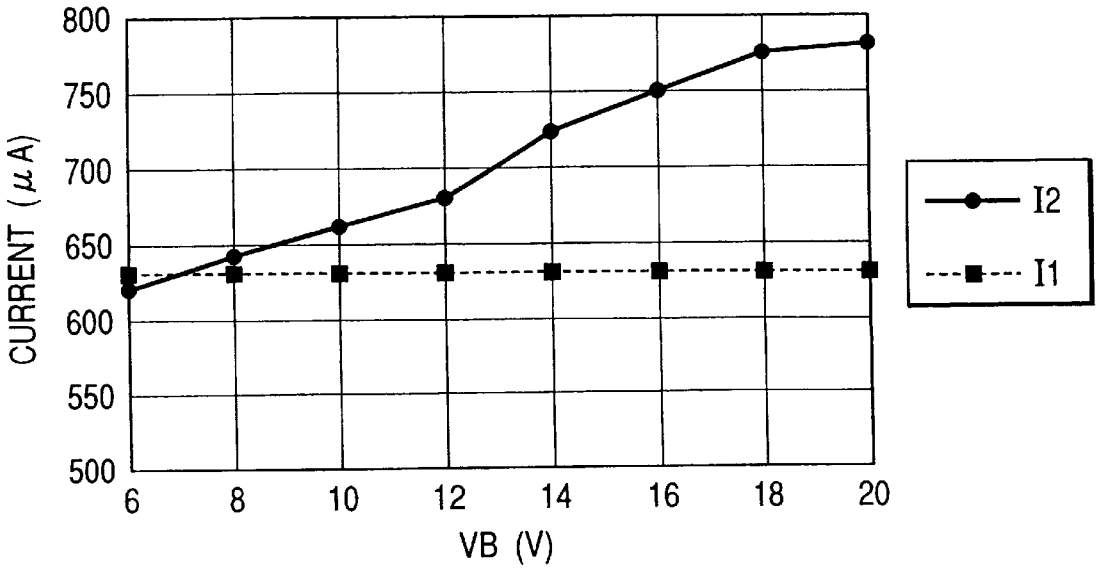
FIG. 9 PRIOR ART
FIG. 9 is a graph showing a relationship between a power source voltage and transistor currents in the conventional constant current circuit shown in FIG. 8.

FIG. 7 shows a detailed arrangement of a constant current circuit 20 supplying the current I3 flowing across the resistor 10 in the load actuating circuit shown in FIG. 6.

A voltage-division circuit 63 interposes between the terminal 61 and the ground to divide the power source voltage VC. A transistor 52 has a base terminal receiving the divided voltage from the voltage-division circuit 63. A resistor 53 interposes between the terminal 61 and a collector of the transistor 52. A transistor 54 has a base terminal connected to the collector of the transistor 52. A resistor 56 interposes between an emitter of the transistor 54 and the ground. The resistor 56 has an electrical potential corresponding to the divided point of the voltage-division circuit 63. A current value flowing across a transistor 54 is obtained by dividing the electrical potential of the resistor 54 by the resistance value of the resistor 56.

A transistor 55 and a transistor 57 cooperatively constitute a current mirror circuit responsive to the transistor 54. When the transistor 57 turns on, the transistor 8 clamps the output transistor 5. The collector potential of output transistor 5 becomes identical with the base-emitter voltage $V_{BE}$ of the transistor 8. The collector current I2 of the output transistor 5 remains constant. The transistor 7 functions as the buffer that has the base current IB1 capable of compensating the lost current (i.e., base current IB2) at the connecting point 12.

Accordingly, even when the power source voltage VB varies, the voltage drop at the resistor 10 remains constant. It becomes possible to detect the reference voltage Vref accurately corresponding to the varied power source voltage VB.

Other Embodiments

According to the above-described first to third embodiments, the current mirror circuit and the early effect cancel circuit use the NPN transistors. However, the substantially the same functions and effects can be realized by replacing these NPN transistors by PNP transistors.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A load actuating circuit comprising:

a switching means having a first terminal receiving a power source voltage, a second terminal connected to a ground via a load, and a control terminal connected to a control circuit;

a resistor having one end connected to said first terminal of said switching means and the other end connected to a constant current circuit for causing a constant voltage drop;

a comparator having one input terminal connected to said other end of said resistor and the other input terminal connected to said second terminal of said switching means for detecting an excessive current flowing across said load by comparing the constant voltage drop at said resistor with a momentary voltage drop between said first and second terminals of said switching means; and said constant current circuit comprising:

a current mirror circuit including an input transistor and an output transistor;

a buffer means for absorbing an electrical potential difference between said other end of said resistor and an output terminal of said output transistor; and a clamp means for fixing an electrical potential of said output terminal of said output transistor.

2. The load actuating circuit in accordance with claim 1, wherein said comparator comprises a pair of differential transistors and an auxiliary constant current circuit for activating said paired differential transistors, and said auxiliary constant current circuit includes an input transistor and an output transistor cooperatively constituting a current mirror circuit and a buffer means and clamp means functioning in the same manner as those in said constant current circuit.

* * * * *